United States Patent [19]

Izu et al.

[11] 4,332,880

[45] Jun. 1, 1982

[54] IMAGING FILM WITH IMPROVED PASSIVATING LAYERS

[75] Inventors: Masatsugu Izu, Birmingham; Vincent D. Cannella, Detroit, both of Mich.

[73] Assignee: Energy Conversion Devices, Inc., Troy, Mich.

[21] Appl. No.: 173,046

[22] Filed: Aug. 4, 1980

Related U.S. Application Data

[63] Continuation-in-part of Ser. No. 72,438, Sep. 4, 1979, abandoned, which is a continuation-in-part of Ser. No. 827,470, Aug. 25, 1977, Pat. No. 4,211,838.

[51] Int. Cl.[3] ..... G03C 1/76

[52] U.S. Cl. ..... 430/272; 430/273; 430/275; 430/276; 430/496; 430/523; 430/525; 430/524; 430/495; 430/961; 430/271

[58] Field of Search ..... 430/66, 155, 272, 273, 430/496, 523, 524, 495, 346, 276, 961, 271; 346/135.1; 427/419 A; 428/469, 471, 472, 620, 622, 630, 633, 632, 641

[56] References Cited

U.S. PATENT DOCUMENTS 3,560,994 2/1971 Wolff et al. ..... 430/524

3,889,272 6/1975 Lou et al. ..... 430/346

4,137,078 1/1979 Izui et al. ..... 430/346

4,211,838 7/1980 Izu et al. ..... 430/502

*Primary Examiner*—Won H. Louie, Jr.

*Attorney, Agent, or Firm*—Lawrence G. Norris

[57] ABSTRACT

In an imaging film having a substrate over which is deposited a thin, opaque layer of an imaging material there is located on at least the outer side of said opaque imaging layer and, better still, on the opposite sides of said opaque layer of imaging material, thin, preferably vapor deposited, passivating layers forming a barrier against passage of oxygen and moisture. The passivating layer, or layers, in a flexible continuous amorphous film having a thickness generally no greater than about 500 Angstroms (A°) and preferably less than 200 A° and comprising an alloy or mixture of a Group IV oxide, most advantageously germanium oxide, and a stabilizing agent or agents, more particularly one or more different oxides of a metal or a semiconductor or a metal fluoride which stabilizes the amorphous character and chemical inertness of the Group IV oxide even when subjected to the elements of the surrounding atmosphere.

13 Claims, 5 Drawing Figures

IMAGING FILM WITH IMPROVED PASSIVATING LAYERS

RELATED APPLICATION

This application is a continuation-in-part of application Ser. No. 072,438, filed Sept. 4, 1979, now abandoned, which, in turn, is a continuation-in-part of application Ser. No. 827,470, filed Aug. 25, 1977, now U.S. Pat. No. 4,211,838, granted July 8, 1980.

BACKGROUND OF INVENTION

The present invention is an improvement over those dispersion imaging films, by way of example, disclosed in the aforesaid copending application Ser. No. 827,470, filed Aug. 25, 1977, now U.S. Pat. No. 4,211,838, granted July 8, 1980, and those disclosed in U.S. Pat. Nos. 4,082,861, granted Apr. 4, 1978, and 4,137,078, granted Jan. 30, 1979, as well as over those disclosed in said copending application Ser. No. 072,438. However, some aspects of this invention have applicability to other types of imaging films which utilize thin layers of material (such as metals, semiconductors or others), which are susceptible to degradation upon exposure to oxygen and/or water vapor in the atmosphere or otherwise. Thus, more generally, the present invention relates to improvements in imaging films carrying passivating layers for preventing or inhibiting the degradation of said imaging films with time due to moisture and/or oxygen which may gain access thereto.

The dispersion imaging films disclosed in the aforesaid application Ser. No. 827,470 and patents comprise a high optical density and substantially opaque layer of a dispersion imaging material deposited on a transparent or substantially transparent substrate and which, upon application of energy thereto in an amount sufficient to increase the absorbed energy in the opaque layer above a certain critical value, disperses or rolls-back to form a discontinuous layer comprising globules and free space therebetween which are frozen in place following the application of such energy and through which free space light can pass. (It should be understood that, in referring to a layer of imaging material, by "layer" is meant a body or film of imaging material which may be comprised of one homogeneous region of a given element or composition, or contiguous layered regions of different elements or compositions forming as a totality what may be considered or termed a single imaging layer of film.) Where a variation in the density of the image obtained is desired, there is produced dispersion inhibiting means for retarding the dispersion or roll-back thereof and for controlling the amount of such dispersion in accordance with the intensity of the applied energy above the certain critical value, to change the area of the openings in the opaque layer and, therefore, the average optical density of the various imaged portions thereof. Such an imaging film is referred to as a continuous tone film.

In high contrast imaging films, the parameters of the opaque layer of dispersion imaging material are such as to provide substantially no retarding of the roll-back of the material in its substantially fluid state from the initial openings therein, so that the roll-back is substantially instantaneous and substantially complete upon application of the applied energy above the certain critical value.

In both these high contrast and continuous tone imaging films, there is commonly provided a protective outermost layer of a suitable transparent synthetic plastic material which is generally permeable to air and moisture for protecting the opaque dispersion imaging film from abrasion damage. The substrate and outer protective layers of these imaging films most desirably are substantially colorless, transparent and flexible. The flexibility of the substrates and other layers of the films is necessary because, among other reasons, the films desirably are wound in rolls during manufacture, storage and shipment thereof. Also, flexibility of the thin outer protective layers of these films is necessary because they must conform without cracking to the variation in thickness of the opaque dispersion material at it disperses or balls-up in the imaging process. Colorless synthetic plastic materials are generally thermoplastic materials which have melting temperatures substantially less than 500° C., which puts limitations on the imaging temperatures of the opaque dispersion film material deposited thereon. Thus, imaging temperatures must be sufficiently low that the substrate and outer protective layer will not be adversely affected by the imaging process.

The thin imaging layers of these dispersion and other types of imaging films are often unstable to long term exposure to air and/or water vapor. (These other types of films include certain light and heat processed films, and films which image by a change of morphological state, e.g. from a crystalline state to an amorphous structure.) Films such as these which are usually susceptible to oxidation and/or hydration or hydrolysis or other form of degradation require passivation layers on one or both sides with several specific requirements. The passivation layers must be continuous (i.e. have negligible holes or voids) and conform to the surface topology of the image layer to provide an effective barrier against the diffusion, for instance, of oxygen and/or water vapor. The passivation layers must also be flexible when the film is to be flexed when wound in a roll or where the changes in imaging layers geometry upon imaging require flexibility, especially for dispersion type films. Experience has shown that the required flexibility is achieved only in passivation layers having a thickness less than about 500 A°, and preferably 100 A°-200 A°. The passivation layers must have long term chemical stability, effective transparency, and must possess properties of adhesion to the adjacent imaging film layers consistent with the structural and photographic requirements of the film. Furthermore, it is desirable that the passivation layers act, in conjunction with the protective layer or layers, usually a polymer coating, to form an effective antireflective optical coating on the imaging layer, to allow the most efficient utilization of the incident energy. Finally, for cost-effective production, it is desirable to have layers which can be deposited rapidly and inexpensively, for example by vapor deposition using electron beam sources.

Amorphous dielectric films such as SiO, $SiO_2$, $TiO_2$, $Si_3N_4$, $Ta_2O_5$, etc. have been used for passivation in the semiconductor industry because of their chemical stability and the absence of grain boundaries through which vapor can diffuse. Similarly, more complex mixtures of oxides, such as pyrex glass, have been tried, but these applications used coatings many times thicker than the 100-200 A° desirable for flexibility. Some of these passivating layers used in the semiconductor industry were layers of fused glass formed of various glass-forming oxides, like lead oxide, boron oxide, aluminum oxide, zinc oxide and silicon dioxide, reference being made, for example, to an article "Passivating Coatings on Silicon Devices" in the Journal of the Electrochemical Society, August, 1975. The application of fused glass layers using the conventional techniques described on page 1096 of this article result in film thicknesses of the order of magnitude of 10,000 A°. While passivating layers made of these glassy materials formed in such thicknesses form good barriers to the passage of moisture and oxygen, they would be completely undesirable in the fabrication of dispersion imaging films of the kind described pursuant to the present invention. In the first place, as indicated above, the economical mass production and handling of imaging films generally requires that they be mountable in rolls which require that they have a high degree of flexibility. Also, passivating layers used in dispersion films must readily flex under the forces of the dispersion process. Fused glass layers of 10,000 A° thick do not have this required flexibility. Moreover, when such passivating layers interface with the opaque dispersion imaging layers thereof, the effect thereof on the imaging characteristics becomes of importance. Such considerations are not present in the silicon devices with which these fused glass layers are utilized. Finally, to preserve the imaging characteristics of the imaging layers, the substrate temperature must be kept cool (below the imaging temperature) during deposition of the passivation layers. This requirement rules out conventional methods of depositing thicker fused glass coatings as well as chemical depositions which involve undesirably high substrate temperatures.

Said copending application Ser. No. 827,470 discloses the use of passivation layers composed of amorphous films of single oxides of semiconductors or metals (SiO, $SiO_2$, $Al_2O_3$, and $GeO_2$). The use of these single component layers has the drawback that no single passivation material possesses all the desired passivation characteristics. When the passivating layers described extend along the faces of the opaque film of dispersion imaging material, they can have an effect upon the solid state interfacial adhesions between the substrate and the opaque layer deposited thereon and the protective layer deposited thereover. Generally speaking, poor solid state adhesion provides higher film sensitivity, while good solid state adhesion provides lower film sensitivity. Also, generally, SiO and $SiO_2$ provide relatively poor solid state adhesion, while $Al_2O_3$ and $GeO_2$ provide relatively good solid state adhesion. $GeO_2$ is flexible, continuous, and transparent, but tends to hydrolize and crystallize on long term exposure to water vapor.

Moreover, production costs of imaging films must be minimized. The most efficient way to produce imaging films is by a continuous mass production process in which the substrate material is unwound from a roll in a vacuum deposition chamber, where the various layers of material required on the substrate are deposited preferably by vapor deposition techniques (which are far more efficient than sputtering deposition techniques). It is thus desirable to use as thin a coating as possible of the passivating and other layers, and to increase the feeding speeds of the unwinding roll of substrate material past the deposition station involved. Thus, for example, it would be highly desirable to have passivating layers which have a thickness as little as 75–150 A°. However, the possibility of providing continuous and stable passivating layers of such minute thicknesses which act as continuous barriers to the diffusion of moisture and oxygen would tend to be assumed, generally speaking, to be unlikely of attainment. In any event, especially in the case of the use of fused glass layers as passivating layers on a dispersion imaging film, because of the large thicknesses which were heretofore utilized for passivating layers in the completely different environment of silicon devices, such fused glass films as a passivating layer on dispersion imaging films would not be useful.

In said copending application Ser. No. 827,470, specific examples of passivating layer thicknesses given for the materials involved were of the order of magnitude of 150 A°. While the passivating layers described therein are satisfactory under certain limited conditions, it was found that they had a less than desired shelf life for many applications. Of the various passivating layers described, the most preferred passivating material for interfacing with continuous tone opaque metal dispersion materials heretofore utilized was germanium oxide, because, as previously indicated, it provides an extremely flexible, thin, continuous layer (even for thicknesses as low as 75 A°). Also, it has excellent adhesion to synthetic plastic material substrates and to the opaque metal dispersion materials found most useful in continuous tone imaging films, and thus either has no adverse effect upon and even sometimes improves the imaging quality of the opaque metal dispersion material. However, as indicated, it was found that the deposited germanium oxide layers tended to hydrolize and crystallize with time, and become cracked under the forces imparted thereto.

Germanium oxide is compatible with most continuous tone opaque dispersion materials because it does not adversely affect the desired controlled roll-back characteristics of such materials and such materials do not adversely interact with the germanium oxide. (A pure silicon dioxide passivating layer, on the other hand, because it offers little or no opposition to the roll-back of the opaque dispersion layer, was found unsatisfactory as a passivating layer interfacing with a continuous tone opaque dispersion layer.) Also, pure silicon dioxide has less than a desirable adhesion to metal surfaces and has less than the desired degree of flexibility. The other passivating layer materials described in said copending application Ser. No. 827,470, while operative and useful, were also found to be wanting in some important quality, like providing a continuous film in thicknesses much less than 200 A°, or because they readily recrystallize.

Accordingly, it is an object of the present invention to provide imaging films, such as dispersion imaging films, which include one or more passivating layers having a thickness no greater than about 500 A°, and preferably substantially less than 500 A° like 200 A° or less, and further wherein such passivating layers maintain their initial continuous, amorphous, barrier-forming character essentially indefinitely, or for prolonged periods of time so that the imaging film has a very long shelf life.

Another object of the invention is to provide imaging films as described where the passivating layer interfaces the dispersion imaging layer thereof, and is not adversely affected thereby or adversely affects the desired imaging qualities thereof.

SUMMARY OF THE INVENTION

In accordance with the present invention, a dispersion imaging film of the kind described is provided, most advantageously on each side of the opaque dispersion imaging layer thereof, with a very thin transparent or substantially transparent and flexible passivating layer forming a long-lasting barrier against the passage of gases and moisture from the surrounding atmosphere. (While, theoretically, the relatively thick, transparent, substrate of the imaging film could act also as a barrier-forming material and avoid the need for a separate passivating layer, there is not presently available a flexible transparent or substantially transparent substrate material which forms a satisfactory barrier to the passage of oxygen and moisture, and so a passivating layer is also preferably added to the substrate side of the opaque dispersion imaging layer.) Each passivating layer, which preferably interfaces the opaque dispersion imaging layer, is a thin, transparent or substantially transparent amorphous film no greater than about 500 A° thick, and preferably under 200 A°, and comprising as a major portion thereof a Group IV oxide, such as PbO, $SiO_2$, $TiO_2$ and $ZrO_2$, but especially germanium oxide. Tin oxide ($SnO_2$) is, generally speaking, not particularly useful but, if used, simply forms a part of the film. Mixtures of the foregoing of such Group IV oxides can be used in which case, advantageously, germanium oxide will be employed in major proportions, advantageously of the order of at least 70 atomic percent, or more, of the mixture of the Group IV oxides, and at least one and preferably at least two, other materials which stabilize the amorphous character of the Group IV oxide. Continuous Group IV oxide films form excellent gaseous and moisture barriers in their amorphous form due to their tetrahedral bonding structure. However, such Group IV materials in pure form are most stable in their crystalline form, and, to stabilize the amorphous state thereof, substantially differently structured materials like oxides of a metal or a semiconductor or a metal fluoride are alloyed or mixed with the main Group IV oxide.

Especially in the case where the passivating layers contact the outer faces of the opaque dispersion imaging layer, the main Group IV oxide, as indicated above, is most advantageously germanium oxide, and it is used in amounts at least about 50 atomic percent of the passivating layer, and most preferably in amounts substantially above 60 atomic percent of the passivating layer (like at least about 70 atomic percent thereof). The situation is similar in relation to the use of other Group IV oxides in the passivating layers. While germanium oxide has the disadvantage that it tends to recrystallize or degrade in the presence of moisture, the substantially differently structured oxides of a metal or a semiconductor or a metal fluoride, or mixtures thereof, alloyed or mixed therewith, make the same substantially inert to moisture and the other elements of the surrounding atmosphere.

Especially useful as alloying or mixing materials with the main amorphous Group IV oxides, such as germanium oxide, are the oxides of bismuth, aluminum, tellurium, tantalum, yttrium, magnesium, zinc, lead, tungsten, cesium, titanium, potassium and boron. Also useful alone or in admixture with said latter oxides as the alloying or mixing materials with the main amorphous Group IV oxides are metal fluorides, illustrative examples of which are $AlF_3$, $ZnF_2$, $CaF_2$, $BaF_2$, $MgF_2$, NaF and KF.

In a component layer where aluminum oxide is added to germanium oxide, for example $(GeO_2)_{0.90}$, $(Al_2O_3)_{0.10}$, the addition of said aluminum oxide improves the chemical resistance and tendency against hydrolysis and also stabilizes the germanium oxide deposition. The addition of lead oxide to germanium oxide, for example $(GeO_2)_{0.90}$, $(PbO)_{0.10}$, lowers the melting point of the germanium oxide deposit and improves film sensitivity. The addition of magnesium fluoride, $(GeO_2)_{0.90}$ $(MgF_2)_{0.10}$ improves film sensitivity. Increasing the additive material to three, four and more of such different metal oxides and/or metal fluorides to provide more complex systems at least in some cases improves further the properties of the Group IV oxide deposit. The amorphous structure of the deposit is stabilized with different coordination patterns with oxygen, or the metal fluoride involved. The evolution of these generally glassy passivation materials follows a direction which allows vapor deposition from a single large rotating crucible containing a homogeneous mixture of the Group IV oxide or oxides and the added other or different oxides of a metal or a semiconductor and/or metal fluorides and using an electron beam source directed upon the outer surface of the mixture. Materials are chosen so as to make uniform glasses before deposition, and to deposit all desirable materials despite differences in evaporation temperatures, and other parameters.

The said different or other metal oxides or semiconductors and/or metal fluorides which are admixed with the Group IV oxides, particularly germanium oxide, to form the passivating layers, and which are exemplified by the illustrative examples set forth above, are those which generally possess the property of lowering the melting point of the germanium oxide and improve film sensitivity. As stated above, such oxides of a metal or a semiconductor and/or metal fluorides generally possess the properties of improving the chemical resistance and tendency against hydrolysis and also stabilize the Group IV oxide, particularly germanium oxide, deposition. The form of said stabilizing materials is not material so long as the resulting passivating film is amorphous or essentially amorphous. Generally, additive materials which cause a crystal mismatch will result in stabilizing the amorphous character of the passivating layers.

Specific examples of passivating compositions encompassed by the invention are the following (where the subscript numbers are the approximate percentages of the crucible mixture by weight of the oxides involved):

$(GeO_2)_{0.90}(Al_2O_3)_{0.05}(PbO)_{0.05}$
$(GeO_2)_{0.70}(Al_2O_3)_{0.10}(B_2O_3)_{0.10}(PbO)_{0.10}$
$(GeO_2)_{0.80}(Al_2O_3)_{0.10}(PbO)_{0.10}$
$(GeO_2)_{0.85}(TiO_2)_{0.10}(Al_2O_3)_{0.05}$
$(GeO_2)_{0.80}(Al_2O_3)_{0.05}(PbO)_{0.05}(K_2O)_{0.10}$
$(GeO_2)_{0.80}(Al_2O_3)_{0.10}(PbO)_{0.05}(K_2O)_{0.05}$
$(GeO_2)_{0.70}(Al_2O_3)_{0.10}(TiO_2)_{0.10}(PbO)_{0.05}(K_2O)_{0.05}$
$(GeO_2)_{0.75}(Al_2O_3)_{0.10}(TiO_2)_{0.05}(MgO)_{0.05}(K_2O)_{0.05}$

These most preferred passivating layer compositions are especially suitable with continuous tone opaque dispersion layers, like those, for instance, comprising a mixture or separate layers of bismuth and tin.

The following compositions constitute other examples of useful passivating layer compositions with continuous tone imaging layers:

| | |
|---|---|
| $(GeO_2)_{.95}(Al_2O_3)_{.05}$ | $(GeO_2)_{.90}(CeO_2)_{.10}$ |
| $(GeO_2)_{.90}(Al_2O_3)_{.10}$ | $(GeO_2)_{.90}(B_2O_3)_{.10}$ |
| $(GeO_2)_{.90}(Al_2O_3)_{.05}(B_2O_3)_{.05}$ | $(GeO_2)_{.75}(B_2O_3)_{.25}$ |
| $(GeO_2)_{.99}(Al_2O_3)_{.01}$ | $(GeO_2)_{.90}(TiO_2)_{.10}$ |
| $(GeO_2)_{.75}(Al_2O_3)_{.25}$ | $(Geo_2)_{.75}(TiO_2)_{.25}$ |
| $(GeO_2)_{.90}(Ta_2O_5)_{.10}$ | $(GeO_2)_{.85}(TiO_2)_{.15}$ |

-continued

| | |
|---|---|
| $(GeO_2)_{.90}(Y_2O_3)_{.10}$ | $(SiO_2)_{.95}(Al_2O_3)_{.05}$ |
| $(GeO_2)_{.90}(MgF_2)_{.10}$ | $(SiO_2)_{.85}(Al_2O_3)_{.15}$ |
| $(GeO_2)_{.90}(ZnO)_{.10}$ | $(SiO_2)_{.90}(PbO)_{.10}$ |
| $(GeO_2)_{.90}(PbO)_{.10}$ | $(SiO_2)_{.90}(CeO_2)_{.10}$ |
| $(SiO_2)_{.80}(Al_2O_3)_{.10}(PbO)_{.10}$ | |
| $(SiO_2)_{.90}(TiO_2)_{.05}(Al_2O_3)_{.05}$ | |
| $(GeO_2)_{.85}(Al_2O_3)_{.05}(PbO)_{.05}(TiO_2)_{.05}$ | |
| $(GeO_2)_{.85}(AlF_3)_{.05}(PbO)_{.05}(TiO_2)_{.05}$ | |
| $(ZrO_2)_{.90}(Al_2O_3)_{.5}(PbO)_{.5}$ | |
| $(ZrO_2)_{.85}(PbO)_{.10}(ZnO)_{.05}$ | |

It should be understood, however, that the broader aspect of the invention encompass alloys or mixtures of (a) one or more Group IV oxides which produce a continuous amorphous film in thickness no greater than about 500 A° and preferably less than 200 A°, with (b) materials which have the property of lowering the melting point of the germanium oxide or other Group IV oxide and do not adversely affect film sensitivity but, rather, desirably improve film sensitivity. Differences in ion sizes and distances in crystal forms of additives, for instance, can effect the aforementioned crystal mismatches but, as previously noted, the manner in which the amorphous or essentially amorphous form of the passivating layers is achieved is not, generally speaking, material to our invention. The additive agents may vary in their crystalline forms which, for instance, may initially be cubic, tetragonal or hexagonal under different conditions but, again, these aspects are not critical to our invention. In a narrower aspect of the present invention, and, as noted above, such (b) materials are one or more oxides of a metal or a semiconductor (other than or different from the particular Group IV oxides utilized as the (a) material) and or a metal fluoride, which stabilize the amorphous character of the Group IV oxide and render the same substantially inert to such elements of the atmosphere as moisture and oxygen. In any event, as previously indicated, it has been discovered that the best passivating layer compositions generally comprise combinations of three or more differently structured materials in the form of metal oxides or semiconductors and metal fluorides, since maximizing the variety of differently structured compositions making up the alloy or mixture tends generally to stabilize to the maximum extent the amorphous character of the Group IV oxide constituting the main passivating layer material, like the especially preferred germanium oxide.

The above stated and other objects, advantages and features of the invention will become still more apparent in light of the following additional disclosures considered in connection with the drawings forming a part of the present application.

DESCRIPTION OF EXEMPLARY FORMS OF THE INVENTION SHOWN IN DRAWINGS

Figure 1:
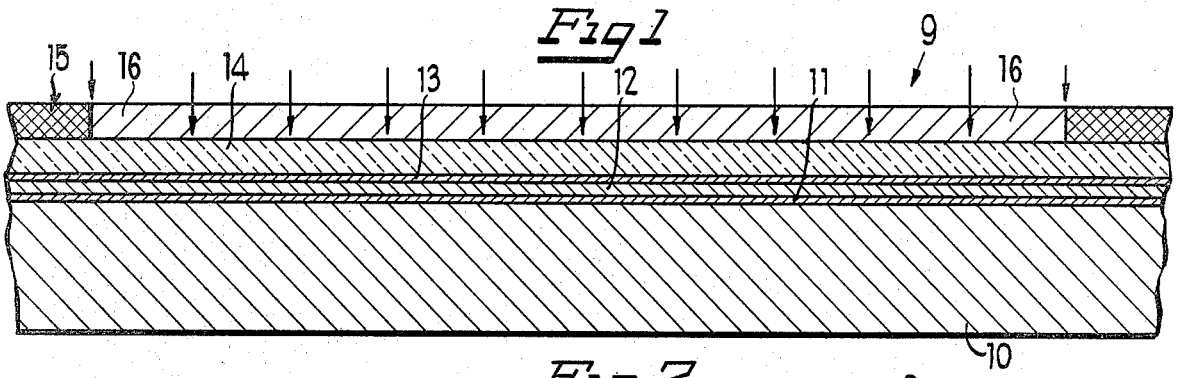
FIG. 1 is a greatly enlarged sectional and stylized view through either a high contrast or continuous tone imaging film incorporating the features of this invention and illustrating the imaging film before it is imaged.

Referring first to FIG. 1, one form of high sensitivity imaging film of this invention is generally designated at 9. It includes a substrate 10 which is preferably transparent, and, while it may be formed from substantially any substrate material, it is preferably formed from a polyester material, such as a polyethylene terephthalate, known as Melinex type 0 microfilm grade, manufactured and sold by ICI of America. The thickness of the substrate 10 is preferably in the range of about 4 to 7 mils.

Deposited on the substrate 10, as preferred by vacuum deposition or the like, is a layer 11 of a transparent passivating material, like those previously described, which is compatible with the layer 12 of opaque dispersion imaging material next to be deposited thereon. As previously indicated, this passivating layer 11 is applied in an amorphous state, preferably by a vapor deposition process well known in the art, and in a thickness not greater than about 500 A°, and preferably much less than 200 A°. The deposition thereof in an amorphous state is ensured by depositing the same while the substrate 10 is backed against a cooled drum surface. Next, the opaque layer 12 of dispersion imaging material is deposited on the passivating layer 11 also preferably by a vapor deposition process. The opaque layer 12 of dispersion imaging material may comprise any one of a number of different, preferably low melting point, metals or metal alloys, as, for example, disclosed in said copending application Ser. No. 827,470 and in said U.S. Pat. Nos. 4,082,861 and 4,137,078. In the preferred exemplary passivating compositions previously disclosed, which comprise a major portion of germanium oxide, the opaque layer 12 is most advantageously a continuous tone film producing material comprising layers of bismuth and tin deposited in the manner described in said copending application. In the case where the opaque layer 12 of imaging material is a high contrast type of film, which must readily roll-back to a maximum extent when energy above a certain critical value is applied thereto, if the particular desired passivating layer is not compatible with such a high contrast film-producing material, there can be deposited over the passivating layer 11 another layer (not shown) which is compatible with such a high contrast film-producing material. In any event, the opaque layer 12 of dispersion imaging material is applied to provide an optical density preferably of about 1.0 to 2.5 in the completed imaging film, depending upon the opacity desired. Generally, the thickness of the film 12 will run about 200 A° to about 1,500 A°.

Next, there is preferably deposited over the opaque layer 12, in a similar way as passivating layer 11 was deposited, a passivating layer 13, as previously indicated, in the case where the opaque layer is a continuous tone film-producing material, the passivating layer preferably containing germanium oxide as the principal material thereof, combined with one or more other or different oxides of a metal or semiconductor and/or metal fluoride, to form a thin, transparent amorphous film 13, like the passivating layer 11 just described. In the case where the opaque layer 12 of dispersion imaging material is a high contrast film-forming material, where it may not be desirable to use a passivating layer having as a major portion thereof germanium oxide, a suitable intervening layer of material compatible with the opaque layer 12 is deposited between the opaque layer 12 and the passivating layer 13.

Deposited over the passivating layer 13 is a substantially transparent overcoat film 14 having a thickness range of about 0.1 to 3 microns and preferably about 0.6 microns and preferably formed of a suitable polymer resin. The overcoat film 14 may comprise a polymer resin coating, for example, polyurethane estane No. 5715 as manufactured and sold by B. F. Goodrich Co., or silicone resin, Dow Corning R-4-3-17 as manufactured and sold by Dow Corning Co., or polyvinylidine chloride (Saran) as manufactured and sold by Dow Chemical Co. For a formatted film, the overcoat film may comprise a photoresist material such as polyvinylcinnamate, for example, a Kodak KPR-4 photoresist manufactured and sold by Eastman-Kodak Co. which is negative working. The overcoat film may be applied by spin coating, roller coating, spraying, vacuum deposition or the like.

The imaging film including the substrate 10, passivating layer 11, opaque layer 12 of dispersion imaging material, passivating layer 13 and the polymer overcoat 14 may be imaged by energy, such as, for example, non-coherent radiant energy from a Xenon lamp or flashbulb or the like through an imaging mask 15 as illustrated in FIGS. 1–4. The imaging mask 15 can control the amount of non-coherent radiant energy passing therethrough and the amount of energy absorbed in the layer 12 of dispersion imaging material and, therefore, can control the amount of dispersion of the dispersion imaging material and the optical density thereof where imaged.

Figure 2:
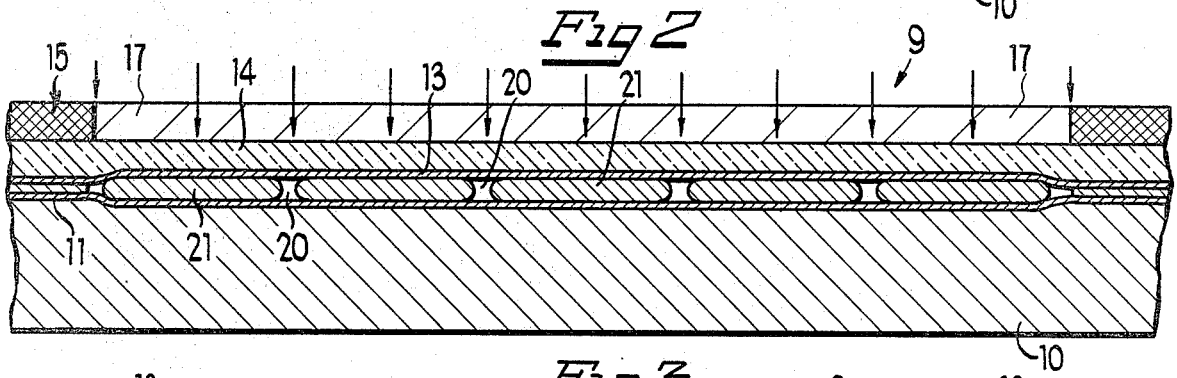
FIG. 2 is a sectional view similar to FIG. 1 illustrating the continuous tone imaging film when it is imaged by the application of relatively low energy above a critical value and having a relatively high optical density.

In FIG. 2, the portion 16 of the imaging mask 15 has a sufficiently high optical density to limit the amount of intensity of the energy applied therethrough to the film 12 of dispersion imaging material, so that the absorbed energy in the material is not increased above the aforesaid certain critical value. As a result, the material is not changed to a substantially fluid state and the layer 12 of dispersion imaging material remains in its solid, high optical density and substantially opaque condition. There are, thus, no openings in the portion of the imaging layer beneath which portion 16 through which light can pass, the layer being substantially opaque and having an optical density of substantially 1.0 to 1.5 or the like. This stage of imaging is applicable to both the high contrast and the continuous tone or gray scale imaging films.

In FIG. 2, the portion 17 of the imaging mask 15 has a lower optical density to allow more radiant energy, as shown by the arrows, to pass through and be applied to the layer 12 of dispersion imaging material. Here, the intensity of the applied energy is such that the absorbed energy in the layer is just above the aforesaid certain critical value. The layer 12 of dispersion imaging material is changed by such energy to a substantially fluid state in which the surface tension of the material causes the material to disperse and change to a discontinuous film having openings 20 and deformed material 21 which are frozen in place following said application of energy and through which openings 20 light can pass. In the case of the continuous tone or gray scale imaging, the dispersion imaging material is deformed only a small amount, as indicated at 21 to provide only small area openings 20 in the layer, there being only a small amount of roll-back of the deformed material 21 from the openings 20. The transmissivity of the layer is low, but more than that of the substantially opaque undispersed film of FIG. 1. Thus, the optical density of the layer, where subject to such application of energy, is decreased a small amount. The area of the substantially opaque deformed material 21 is, relatively, very large while the area of the openings 20 is, relatively, very small.

Figure 3:
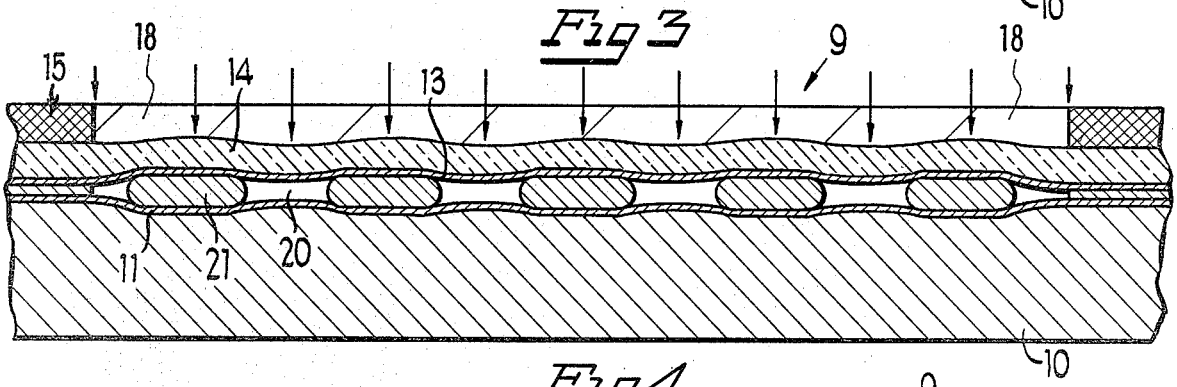
FIG. 3 is a sectional view similar to FIGS. 1 and 2 and illustrating the continuous tone imaging film when it has been subject to a greater amount of energy above the critical value and having a lower optical density.

In FIG. 3, the portion 18 of the imaging mask 15 has a lower optical density to allow still more radiant energy, as shown by the arrows, to pass therethrough and be applied to the layer 12 of the dispersion imaging material. The intensity of the applied energy is such that the absorbed energy in the layer is considerably above the aforesaid certain critical value. Because of the increased intensity of the applied energy, the dispersion imaging material is deformed a greater extent as indicated at 21 to provide large area openings 20 in the layer 12, there being a larger amount of roll-back of the deformed material 21 from the openings 20. The transmissivity of the layer is thus increased, the optical density thereof decreased a greater amount.

Figure 4:
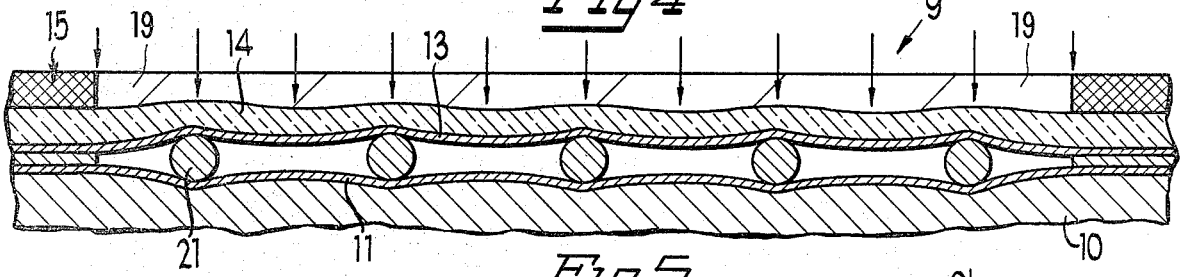
FIG. 4 is a sectional view similar to FIGS. 1, 2 and 3, and illustrating the continuous tone imaging film when subjected to a still greater amount of energy and the imaged high contrast film and having a minimum optical density.

In FIG. 4, the portion 19 of the imaging mask 15 has a still lesser optical density to allow still more radiant energy, as shown by the arrows, to pass therethrough and be applied to the layer of dispersion imaging material. Here, the intensity of the applied energy is such that the absorbed energy in the layer 12 is still more above the aforesaid certain critical value, substantially a maximum value. Because of this further increased intensity of the applied energy, the dispersion imaging material is deformed a greater extent to small spaced globules 21 and the openings 20 are increased to form substantially free space between the globules, there being a larger roll-back of the deformed material 21 from the openings 20. The transmissivity of the layer is thus increased to a maximum and the optical density thereof decreased to a minimum.

As distinguished from the continuous tone or gray scale imaging having the intermediate steps illustrated in FIGS. 2 and 3, in the high contrast imaging, upon the formation of the openings 20 and the deformed material 21, there is a substantial instantaneous and complete roll-back of the imaging material to the discontinuous film condition illustrated in FIG. 4. Accordingly, the continuous tone or gray scale imaging utilizes an imaging layer having a low gamma, while the high contrast imaging utilizes an imaging film having a high gamma.

Figure 5:
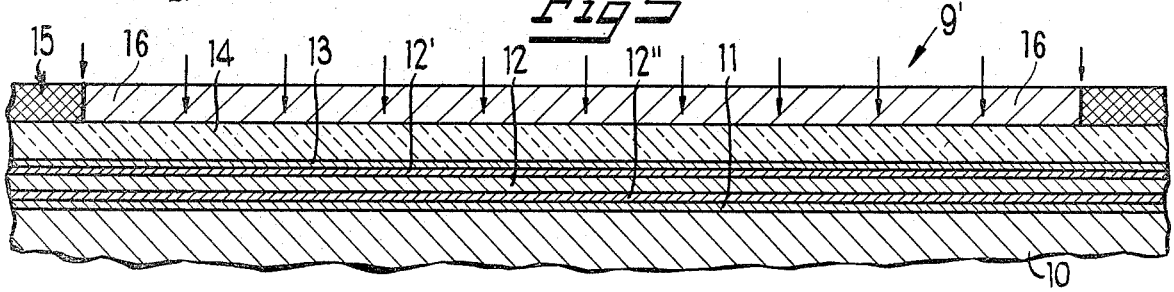
FIG. 5 is a greatly enlarged sectional and stylized view through a high contrast or continuous tone imaging film incorporating the passivating layers in the invention, this imaging film differing from that shown in FIGS. 1 through 4 in that the passivating layers are separate from the imaging layer by intervening layers of a different material.

FIG. 5 illustrates a dispersion imaging film 9' wherein there is interposed between the imaging layer 12 and the outermost passivating layer 13 an intervening layer 12' of a suitable material which improves the roll-back characteristic of the imaging layer 12. Among the materials which can be utilized for this purpose are organic polymers such as those disclosed in copending U.S. patent application Ser. No. 141,568, filed Apr. 18, 1980, entitled "Imaging Film and Method". Exemplary of one such material is a polymer formed from a fluorinated hydrocarbon, specifically carbon tetrafluoride. There is also desirably interposed between the innermost passivating layer 11 and the imaging layer 12 another intervening layer 12″. The intervening layers 12′ and 12″ may be vacuum deposited to a thickness, for example, of about 30–50 A°. Since the passivating layers 11 and 13 are not in direct contact with the imaging layer, the passivating layers need not be selected to avoid adverse effects upon the roll-back characteristic of the imaging layer. Thus, in such case, it may not be as important to have germanium oxide as the particularly preferred Group IV passivating layer material, although this material has other excellent qualities described, making it especially suitable as a passivating layer material even when not in contact with the imaging layer.

As previously indicated, the various layers of material between the imaging layer of the imaging film involved and the side of the film from which the imaging energy is directed most desirably should form an effective anti-reflective optical coating to allow the most efficient utilization of incident energy, usually light energy. Both the thickness and the nature of the passivating material affect the anti-reflective properties of the various layers referred to. In the case of the passivating layer materials, with the proper choice of materials, index of refraction etc. of the associated layers, passivating layer thicknesses no greater than about 500 A° form an excellent transparent anti-reflective coating.

The imaging films of the present invention incorporating the unique passivating layers as described maintain their initial continuous amorphous barrier so that the imaging layers involved have a very long, almost indefinite, practically speaking, shelf life. Additionally, the compositions involved lend themselves to high speed vacuum deposition with very thin film thicknesses, using, for example, an electron beam impinging upon a mixture of the various materials involved in a continuously rotating ceramic crucible.

It should be understood that numerous modifications may be made in the specific passivating layer compositions in this application, in light of the disclosures and teachings provided herein, without deviating from the broader aspects of the invention.

We claim:

1. In a dry process dispersion imaging film comprising a transparent substrate, a solid, high optical density and substantially opaque layer of a dispersion imaging material deposited on said substrate, said substantially opaque layer of dispersion imaging material, upon application of energy in an amount sufficient to increase the absorbed energy in the material above a certain critical value, being capable of changing to a substantially fluid state in which the surface tension of the material acts to cause the substantially opaque layer of dispersion material where subject to said energy to disperse and change to a discontinuous layer, the improvement wherein there is located on at least the outer side of said opaque layer of dispersion material a substantially transparent passivating layer for isolating said opaque imaging layer from the surrounding atmosphere, said passivating layer comprising a substantially transparent continuous amorphous film having a thickness no greater than about 500 A°, said amorphous film comprising at least about 50 atomic weight percent of a Group IV oxide (except oxides of carbon) alloyed or mixed with one or more other different oxides of a metal or an inorganic semiconductor or a metal fluoride which stabilizes the amorphous character of said Group IV oxide.

2. The imaging film of claim 1 wherein said Group IV oxide is germanium oxide.

3. In an imaging film comprising a transparent substrate, an imaging layer of opaque imaging material imageable by external energy and susceptible to degradation by the external elements, said imaging layer being deposited on said substrate, the improvement wherein there is located on at least the outer side of said imaging layer a substantially transparent passivating layer for isolating said imaging layer of opaque imaging material from the surrounding atmosphere, said passivating layer comprising a substantially transparent continuous amorphous film having a thickness no greater than about 500° A, said amorphous film comprising at least about 50 atomic weight percent of a Group IV oxide (except oxides of carbon) alloyed or mixed with one or more different oxides of a metal or an inorganic semiconductor or a metal fluoride which stabilizes the amorphous character of said Group IV oxide.

4. The imaging film of claim 5 wherein said Group IV oxide is germanium oxide.

5. The imaging film of claims 1, 2, 3 or 6, wherein said Group IV oxide comprises substantially greater than 60 atomic percent of the passivating layer composition.

6. The imaging film of claims 1, or 3 wherein there is a passivating layer as described on each side of said layer of imaging material.

7. The imaging film of claim 2 or 4 wherein said substantially opaque layer of dispersion material is a metal or an inorganic semiconductor material.

8. The imaging film of claim 1 wherein said passivating layer interfaces said substantially opaque layer of dispersion material which includes means associated with said substantially opaque layer of dispersion material for retarding the change to the discontinuous film, caused by the surface tension, and for controlling the amount of such change in accordance with the intensity of the applied energy above said certain critical value to increase the amount of said change and the area of the openings in the film and decrease the area of the deformed material in the film and, therefore, the optical density of the film in accordance with the intensity of the applied energy above said certain critical value for providing continuous tone imaging of the dry process imaging film, and said Group IV oxide is germanium oxide.

9. The imaging film of claim 1 or 2, wherein said substantially opaque layer of dispersion material comprises bismuth and tin which interfaces with said passivating layer.

10. The imaging film of claim 1, 2, 3 or 4 wherein said one or more oxides of a metal or semiconductor alloyed or mixed with said Group IV oxide comprise aluminum oxide, tantalum oxide, yttrium oxide, magnesium oxide, zinc oxide, lead oxide, tungsten oxide, cesium oxide, boron oxide, titanium oxide, potassium oxide, bismuth oxide or tellurium oxide, or a combination of two or more of the same.

11. The imaging film of claims 2, 3 or 4 wherein said one or more oxides of a metal or semiconductor is aluminum oxide, boron oxide, zinc oxide, lead oxide, titanium oxide, magnesium oxide or potassium oxide, or a combination of two or more of the same.

12. The imaging film of claim 1 or 3 wherein said Group IV oxide is germanium oxide, and said one or more different oxides of a metal or semiconductor or a metal fluoride alloyed or mixed with said Group IV oxide comprises at least two such additional materials.

13. The imaging films of claim 1, or 3 wherein each passivating layer has a thickness substantially less than 200 A°.

* * * * *

UNITED STATES PATENT AND TRADEMARK OFFICE

CERTIFICATE OF CORRECTION

PATENT NO. : 4,332,880

DATED : June 1, 1982

INVENTOR(S) : Masatsugu Izu et al.

It is certified that error appears in the above—identified patent and that said Letters Patent is hereby corrected as shown below:

In the Abstract, line 8, change "in" to --is--.
Column 2, line 13, change "at" to --as--.
Column 12, claim 4, line 1, change "5" to --3--;
claim 5, line 1, change "6" to --4--.

Signed and Sealed this

*Fifteenth* Day of *February 1983*

[SEAL]

*Attest:*

GERALD J. MOSSINGHOFF

*Attesting Officer*

*Commissioner of Patents and Trademarks*